US008585887B2

(12) United States Patent
Hiratsuka et al.

(10) Patent No.: US 8,585,887 B2
(45) Date of Patent: Nov. 19, 2013

(54) ALUMINUM ALLOY MEMBER AND METHOD FOR MANUFACTURING SAME

(75) Inventors: Ichiro Hiratsuka, Anjo (JP); Mie Tokuhara, Anjo (JP); Tomoyoshi Konishi, Chuo-ku (JP); Arata Suda, Chuo-ku (JP)

(73) Assignees: Aisin Seiki Kabushiki Kaisha, Kariya-shi (JP); Nihon Parkerizing Co., Ltd., Tokyo (JP)

( * ) Notice: Subject to any disclaimer, the term of this patent is extended or adjusted under 35 U.S.C. 154(b) by 0 days.

(21) Appl. No.: 13/620,984

(22) Filed: Sep. 15, 2012

(65) Prior Publication Data

US 2013/0015072 A1 Jan. 17, 2013

Related U.S. Application Data

(62) Division of application No. 12/536,881, filed on Aug. 6, 2009, now abandoned.

(30) Foreign Application Priority Data

Aug. 6, 2008 (JP) ..... 2008-202781

(51) Int. Cl.
*C25D 11/06* (2006.01)

(52) U.S. Cl.
USPC ..... 205/323; 205/333

(58) Field of Classification Search
None
See application file for complete search history.

(56) References Cited

U.S. PATENT DOCUMENTS

| | | | |
|---|---|---|---|
| 2,567,877 A | 9/1951 | De Ment | |
| 5,527,562 A | 6/1996 | Balaba et al. | |
| 5,669,436 A | 9/1997 | Papich et al. | |
| 6,264,817 B1 | 7/2001 | Timoshenko et al. | |
| 6,544,357 B1 | 4/2003 | Hehmann et al. | |
| 2003/0070936 A1 | 4/2003 | Dolan | |
| 2003/0079994 A1 | 5/2003 | Dolan | |
| 2003/0150419 A1* | 8/2003 | Daragheh et al. | 123/193.6 |
| 2005/0061680 A1 | 3/2005 | Dolan | |
| 2005/0115839 A1 | 6/2005 | Dolan | |
| 2005/0115840 A1 | 6/2005 | Dolan | |
| 2006/0013986 A1 | 1/2006 | Dolan | |
| 2006/0101992 A1 | 5/2006 | Hiratsuka | |
| 2008/0086195 A1* | 4/2008 | Atanasoka et al. | 623/1.15 |
| 2008/0093223 A1 | 4/2008 | Yoshioka et al. | |
| 2008/0175747 A1 | 7/2008 | Kajihara et al. | |
| 2008/0236386 A1 | 10/2008 | Hiratsuka | |
| 2009/0098373 A1 | 4/2009 | Dolan | |
| 2009/0258242 A1 | 10/2009 | Dolan | |
| 2010/0025253 A1 | 2/2010 | Yoshioka et al. | |

FOREIGN PATENT DOCUMENTS

| | | |
|---|---|---|
| EP | 1657326 | 5/2006 |
| JP | 8-209389 | 8/1996 |
| JP | 3129494 | 11/2000 |
| JP | 2006-144574 | 6/2006 |
| JP | 2006-258149 | 9/2006 |
| WO | WO 2005/118919 A1 | 12/2005 |
| WO | 2008/041455 | 4/2008 |

OTHER PUBLICATIONS

Han et al, Porous nanocrystalline titania films by plasma electrolytic oxidation, Surface and Coatings Technology, vol. 154 Issues 2-3, May 2002, pp. 314-318.*
Maryland Metrics Technical Data Chart, 2008, p. 1-2.
Japanese Office Action issued May 9, 2013 in connection with Japanese Patent Application No. 2008-202781, filed Aug. 6, 2008.

* cited by examiner

*Primary Examiner* — Harry D Wilkins, III
(74) *Attorney, Agent, or Firm* — Oblon, Spivak, McClelland, Maier & Neustadt, L.L.P.

(57) ABSTRACT

An aluminum alloy member includes a main body including an aluminum alloy serving as a base material, and an electrolytic oxidation ceramic coating coated at a portion of a surface of the main body and including a most outer layer and an inner layer which is arranged close to the main body relative to the most outer layer, the inner layer in which an aluminum oxide is richer than the most outer layer, the most outer layer in which a volume of a titanium oxide or a total volume of the titanium oxide and a zirconium oxide is richer than the inner surface.

8 Claims, 8 Drawing Sheets

ALUMINUM ALLOY MEMBER AND METHOD FOR MANUFACTURING SAME

The present application is a division of U.S. Ser. No. 12/536,881, filed Aug. 6, 2009, now abandoned.

CROSS REFERENCE TO RELATED APPLICATIONS

This application is based on and claims priority under 35 U.S.C. §119 to Japanese Patent Application 2008-202781, filed on Aug. 6, 2008, the entire content of which is incorporated herein by reference.

FIELD OF THE INVENTION

The present invention relates to an aluminum alloy member and a method for manufacturing the same.

BACKGROUND

In recent years, an aluminum alloying process has been applied to parts of vehicles, industrial instruments, and the like. Because a usage environment of such parts is severe, anodizing is applied in view of abrasion resistance and high strength. JP3129494B (hereinafter referred to as Reference 1) discloses a piston for an internal combustion engine where an anodic oxide coating is formed on a surface of a piston base material. According to the piston disclosed in Reference 1, silicon grains are removed from a lower surface of a land groove formed at a land portion of the piston. Then, the anodic oxide coating is applied to the land groove where the silicon grains are removed. In addition, JP08-209389 (hereinafter referred to as Reference 2) discloses a technology for forming an anodic oxide coating on a wall surface of a ring groove of a piston. The hardness of the anodic oxide coating is generally in a range from HV (Vickers Hardness) 200 to HV 400.

Further, an electrolytic oxidation that is also called a plasma electrolytic oxidation and that includes a more prominent coating than the anodic oxide coating for the abrasion resistance, the high strength and a surface roughness has been attracting a lot of attention. In the electrolytic oxidation, because a surface of an aluminum member is formed by a hard electrolytic oxidation ceramic coating mainly constituted by an alpha alumina, the aluminum member is given prominent characteristics in view of the abrasion resistance, the high strength and the surface roughness.

WO2005-118919 (hereinafter referred to as Reference 3) discloses an electrolytic oxidation that is also called a plasma electrolytic oxidation. According to the electrolytic oxidation disclosed, in a state where a processed part is immersed in an alkaline electrolyte in which a zirconium compound is included, an electrolytic oxidation ceramic coating that includes a metal element of a base material element and a zirconium is formed at the processed part by use of an alternating current voltage. The electrolytic oxidation ceramic coating has the hardness of HV 800 or more because of a dispersed phase of a microcrystal of a dispersed zirconium oxide.

According to the electrolytic oxidation ceramic coating formed by the technology disclosed in Reference 3, a large surface projection may be generated at a surface layer, which leads to a rough surface. Thus, an abrasion tends to originate from the surface projection, which results in a large abrasion amount of the coating itself and a high aggressiveness to the other member such as a mating member caused by abrasion powder, and the like. In particular, in a case where silicon is included in a base material of the aluminum alloy, a silicon oxide is generated on the silicon and thereon further laminated is a zirconium oxide. As a result, a large surface projection tends to be generated at the electrolytic oxidation ceramic coating. When the electrolytic oxidation ceramic coating slides with the mating member, the abrasion tends to originate from the surface projection, which leads to the large abrasion amount of the coating itself and the high aggressiveness to the mating member as mentioned above.

A need thus exists for an aluminum alloy member and a method for manufacturing the same which is not susceptible to the drawback mentioned above.

SUMMARY OF THE INVENTION

According to an aspect of the present invention, an aluminum alloy member includes a main body including an aluminum alloy serving as a base material, and an electrolytic oxidation ceramic coating coated at a portion of a surface of the main body and including a most outer layer and an inner layer which is arranged close to the main body relative to the most outer layer, the inner layer in which an aluminum oxide is richer than the most outer layer, the most outer layer in which a volume of a titanium oxide or a total volume of the titanium oxide and a zirconium oxide is richer than the inner surface.

According to a further aspect of the present invention, a method for manufacturing an aluminum alloy member includes steps of preparing a main body including an aluminum alloy serving as a base material and an electrolyte including a zirconium compound and a titanium compound or an electrolyte including the titanium compound and forming an electrolytic oxidation ceramic coating at a portion of a surface of the main body by applying a voltage between the main body and a mating pole in a state where the main body and the mating pole are immersed in the electrolyte.

BRIEF DESCRIPTION OF THE DRAWINGS

The foregoing and additional features and characteristics of the present invention will become more apparent from the following detailed description considered with the reference to the accompanying drawings, wherein.

DETAILED DESCRIPTION

Each embodiment will be described hereinafter.

[First Embodiment]

A test piece (main body) 1 having an aluminum alloy as a base material, and a container 3 containing an alkali electrolyte (electrolyte) 2 are prepared. The test piece 1 is formed in a manner where a heat treatment (T6 treatment) is applied to an aluminum alloy casting. A size of the test piece 1 is 15.75 millimeter by 6.35 millimeter by 10.16 millimeter. The aluminum alloy labeled as JIS-AC8A (an aluminum alloy casting, an alloy of aluminum, silicon, copper and magnesium) is used. The aluminum alloy includes 12% of silicon, 1% of copper and 1% of magnesium, in mass ratio.

The alkali electrolyte 2 is provided in a manner where a phosphor compound, a zirconium compound and a titanium compound are dissolved in water. The phosphor compound is a sodium pyrophosphate ($Na_4P_2O_7.10H_2O$). The phosphor compound contributes toward smoothing roughness of a surface of an electrolytic oxidation ceramic coating and toward stabilizing the electrolyte. The zirconium compound is a potassium zirconium carbonate ($K_2[Zr(OH)_2(CO_3)_2]$). The zirconium compound becomes a component of the electrolytic oxidation ceramic coating. The titanium compound is potassium titanium oxalate ($K_2[TiO(C_2O_4)_2].2H_2O$). The titanium compound serves as catalyst during a coating formation. The phosphor compound, the zirconium compound and the titanium compound are soluble in water.

In the alkali electrolyte 2, a concentration of the sodium pyrophosphate is 25.92 g/L, a concentration of the potassium zirconium carbonate is 8.51 g/L and a concentration of the potassium titanium oxalate is 10.27 g/L. An atomic number ratio in the alkali electrolyte 2 is: zirconium (Zr):titanium (Ti)=1:1 and phosphor (P):zirconium (Zr):titanium (Ti)=4.4:1:1.

Figure 1:
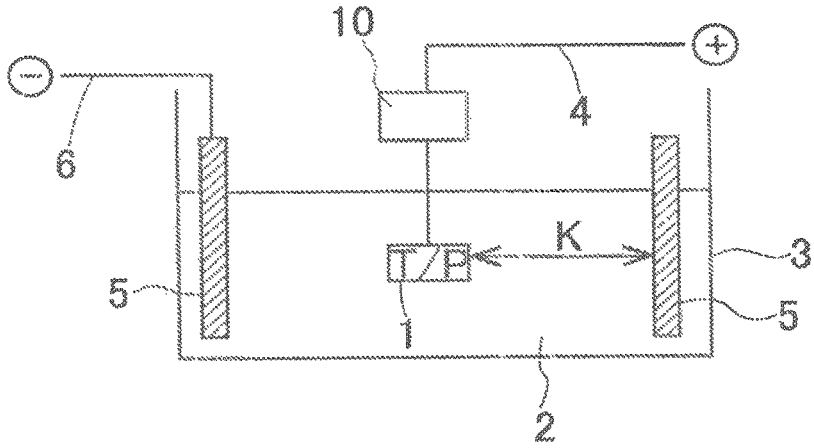
FIG. 1 is a cross-sectional view schematically illustrating a manner of electrolytic oxidation for forming an electrolytic oxidation ceramic coating according to a first embodiment.
Figure 2:
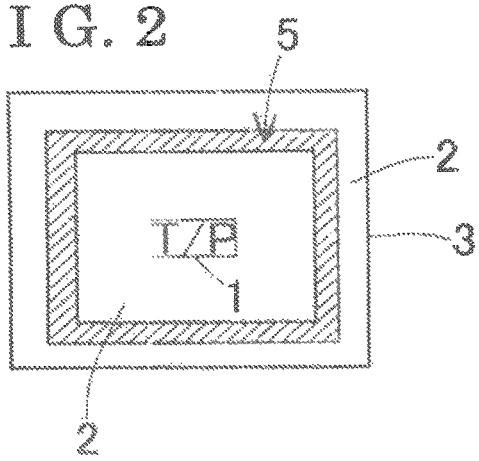
FIG. 2 is a front view schematically illustrating the manner of electrolytic oxidation for forming the electrolytic oxidation ceramic coating according to the first embodiment.

As illustrated in FIGS. 1 and 2, the rectangular-solid-shaped test piece (main body) 1, serving as an electrode, is immersed in the alkali electrolyte 2 (cubic capacity: approximately 20 liters), contained in the container 3 via a first fixing jig 10. Further, a square-ring-shaped mating pole 5 is immersed in the alkali electrolyte 2, contained in the container 3. The test piece 1 is connected to a terminal of a power source device via a first electrode jig 4. The mating pole 5 is connected to another terminal of the power source device via a second electrode jig 6. The mating pole 5 is made of stainless steel (SUS304). Thus the test piece 1 and the mating pole 5 are immersed in the alkali electrolyte 2. FIG. 2 is a planar view illustrating a state where the coating is being formed in the container 3. As illustrated in FIG. 2, the mating pole 5 is formed into a square-ring shape, extending annularly around the test piece 1 in a continuous manner. As will be described later, an absolute value of a pulse of a positive electric potential is larger than an absolute value of a pulse of a negative electric potential. Therefore, the mating pole 5 is specified to be a negative pole and the test piece 1 is specified to be a positive pole.

In such a state, an electrical voltage (alternative current voltage) is applied between the test piece 1 and mating pole 5 from the power source device. The coating formation is conducted while electricity is discharged (glow discharge or arc discharge). Both of or one of the glow discharge and the arc discharge may occur.

A target thickness of the electrolytic oxidation ceramic coating is specified to be 5.0 μm. An average distance K (see FIG. 1) between a portion of the test piece 1 where the coating is formed and the mating pole 5 is specified to be 2.5 centimeters. While the coating is being formed, a temperature of the electrolytic oxidation ceramic coating is cooled to 5° C. or less by means of a heat exchanger so as to restrict a generation of roughness of the surface of the electrolytic oxidation ceramic coating. A temperature of the test piece 1 is left to nature. The speed of coating formation is specified to be 3.1 to 3.2 μm/min.

Figure 3:
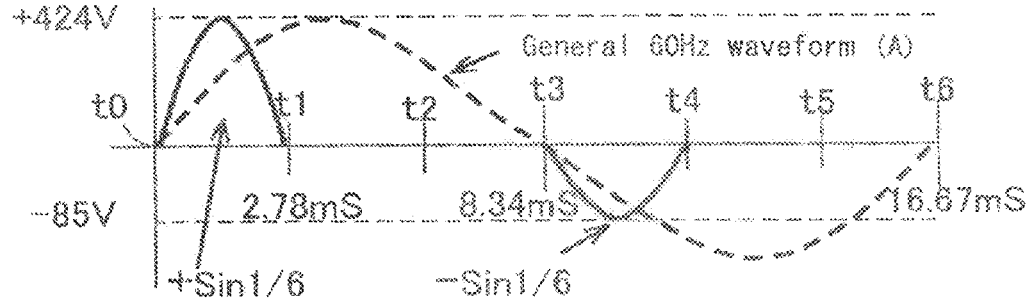
FIG. 3 is a waveform diagram illustrating waveforms of voltage applied between a test piece and a mating pole in the electrolytic oxidation according to the first embodiment.

FIG. 3 illustrates waveforms of the alternative current voltage (duty ratio=2/6≈0.33) according to a first embodiment, applied between the test piece 1 and the mating pole 5. A characteristic line A shown in FIG. 3 illustrates a sine waveform of the general alternative current voltage in 60 Hz. One period (16.67 millisecond) of the alternative current voltage is equally divided into six parts so as to specify time t0, time t1, time t2, time t3, time t4, time t5 and time t6. +Sin1/6 shows a time range where the pulse of the positive electric potential is applied for 1/6 of the period. −Sin1/6 shows a time range where the pulse of the negative electric potential is applied for 1/6 of the period.

According to the first embodiment, the pulse of the positive electric potential is applied from time t0 (energization starting time) to time t1 (2.78 milliseconds) so that a maximum voltage becomes +424 volt. The pulse of the positive electric potential stimulates elution from the base material, made of the aluminum alloy so as to form the electrolytic oxidation ceramic coating. Then, the voltage is not applied from time t1 (2.78 milliseconds) to time t3 (8.34 milliseconds) (i.e., non-energization time). Further, the pulse of the negative electric potential is applied from time t3 (8.34 milliseconds) to time t4 (11.12 milliseconds) so that a maximum voltage becomes −85 volt. The pulse of the negative electric potential stimulates elution of the base material and elution of the formed electrolytic oxidation ceramic coating. Then, voltage is not applied from time t4 (11.12 millisecond) to time t6 (16.67 milliseconds) (i.e., non-energization time). Thus the periodical alternative current voltage is repetitively applied. As described above, the alternative current voltage is applied between the test piece 1 and the mating pole 5, so that the electrolytic oxidation ceramic coating is formed on a surface of the test piece 1. The coating formation time is specified to be 90 seconds.

The followings are confirmed according to the first embodiment. When a time frame from the time point when the application of the pulse of the positive electric potential is finished (time t1) to the time point when the application of the pulse of the negative electric potential starts (time t3) is specified to be relatively long, the roughness of the surface of the electrolytic oxidation ceramic coating is restricted but the electrolytic oxidation ceramic coating is formed relatively slow. On the other hand, when a time frame from the time point when the application of the pulse of the positive electric potential is finished (time t1) to the time point when the application of the pulse of the negative electric potential starts (time t3) is specified to be relatively short, the electrolytic oxidation ceramic coating is formed quicker but the roughness of the surface of the electrolytic oxidation ceramic coating increases.

When the absolute value of the negative electric potential is specified to be relatively small, the electrolytic oxidation ceramic coating is formed relatively slow. On the other hand, when the absolute value of the negative electrolytic oxidation ceramic coating is specified to be relatively large, the electrolytic oxidation ceramic coating is formed relatively quickly. However, when the absolute value of the negative electric potential is excessively large, the test piece (the main body) 1 suddenly develops heat, and the roughness of the surface of the electrolytic oxidation ceramic coating increases.

When the distance between the test piece 1 and the mating pole 5 is relatively short, the electrolytic oxidation ceramic coating is formed relatively quickly but the roughness of the surface of the electrolytic oxidation ceramic coating increases. On the other hand, when the distance between the test piece 1 and the mating pole 5 is relatively long, the electrolytic oxidation ceramic coating is formed relatively slow.

When only the pulse of the positive electric potential may be applied, the electrolytic oxidation ceramic coating is formed relatively slow, and the roughness of the surface of the electrolytic oxidation ceramic coating increases. On the other hand, as in the first embodiment, when both the pulse of the positive electric potential and the pulse of the negative electric potential are applied, the electrolytic oxidation ceramic coating is formed relatively quickly and the roughness of the surface of the electrolytic oxidation ceramic coating decreases. Therefore, a level of smoothness is improved.

Figure 6:
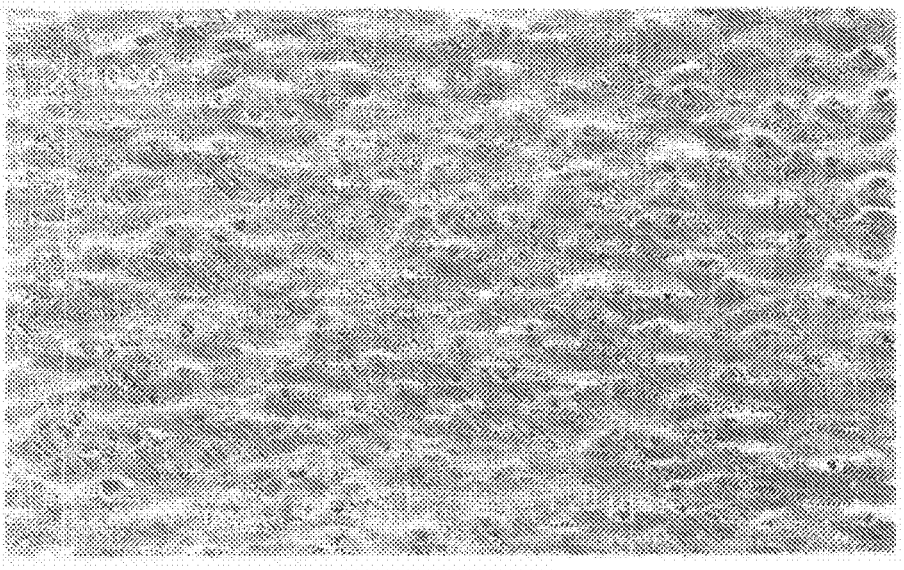
FIG. 6 is a diagram illustrating a surface of the electrolytic oxidation ceramic coating formed in the electrolytic oxidation according to the first embodiment.
Figure 7:
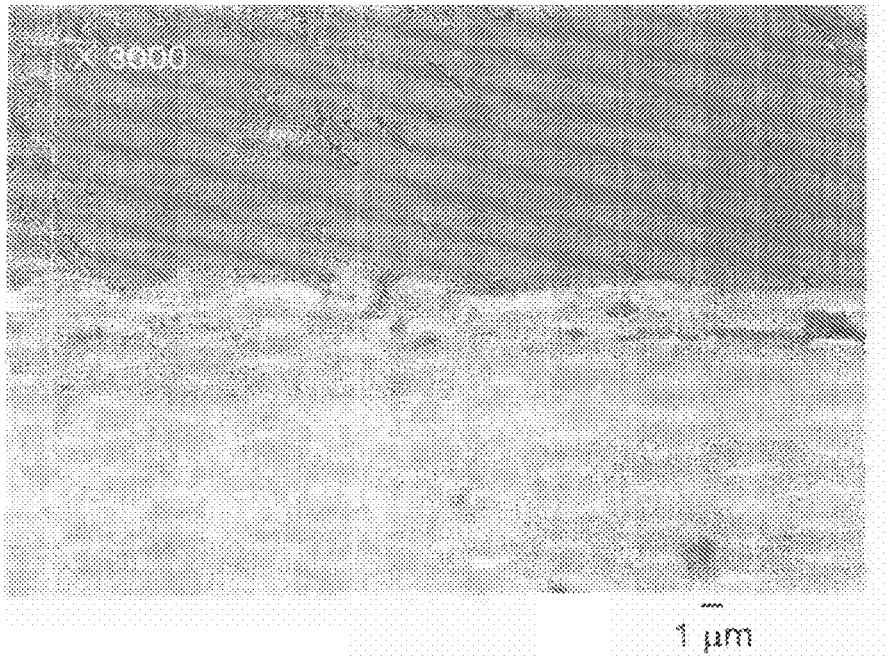
FIG. 7 is a diagram illustrating a cross-section of the electrolytic oxidation ceramic coating formed in the electrolytic oxidation according to the first embodiment.
Figure 10:
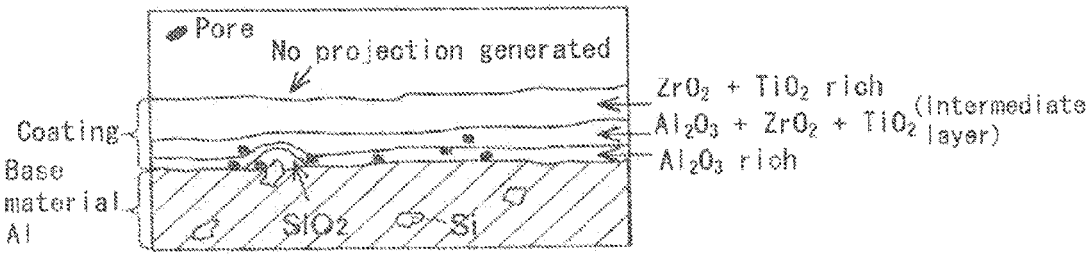
FIG. 10 is a schematic diagram illustrating the cross-section of the electrolytic oxidation ceramic coating formed in the electrolytic oxidation according to the first embodiment.

FIGS. 6 and 7 each illustrate an example of a configuration of the electrolytic oxidation ceramic coating according to the first embodiment. FIG. 6 illustrates an example of the surface of the electrolytic oxidation ceramic coating (magnification ratio: 1000-fold). FIG. 7 illustrates an example of the cross-section of the electrolytic oxidation ceramic coating (magnification ratio:

3000-fold). FIG. 10 schematically illustrates the cross-section of the electrolytic oxidation ceramic coating according to the first embodiment.

As illustrated in FIGS. 7 and 10, according to the electrolytic oxidation ceramic coating observed by means of a scanning electron microscope (SEM), the electrolytic oxidation ceramic coating includes an inner layer, an outer layer and an intermediate layer. The inner layer is rich in aluminum oxide ($Al_2O_3$, shown in light gray in FIG. 7) coated on the surface of the main body (test piece 1) having the aluminum alloy as the base material. The outer layer, forming a most outer layer of the electrolytic oxidation ceramic coating, is rich in zirconium oxide ($ZrO_2$) and titanium oxide ($TiO_2$). The intermediate layer, positioned between the inner and outer layers, includes an aluminum oxide ($Al_2O_3$), a zirconium oxide ($ZrO_2$) and a titanium oxide ($TiO_2$). "Rich" used hereinafter refers to the fact that a dimensional ratio is large. Further, the inner layer, the outer layer and the intermediate layer may be clearly distinguishable from each other, or may not be clearly distinguishable from each other.

The inner layer serving as the aluminum oxide layer is formed on the surface of the main body (test piece 1) having the aluminum alloy as the base material. The inner layer is rich in aluminum oxide ($Al_2O_3$). The inner layer may also include at least one of the zirconium oxide ($ZrO_2$) and the titanium oxide ($TiO_2$).

The outer layer is rich in zirconium oxide ($ZrO_2$) and titanium oxide ($TiO_2$). The outer layer may also include the aluminum oxide ($Al_2O_3$).

According to a result of an X-ray diffraction of the first embodiment, a ratio of $\alpha$- $Al_2O_3$ existing in the aluminum oxide is relatively low, and a ratio of $\gamma$- $Al_2O_3$ existing in the aluminum oxide is higher than $\alpha$- $Al_2O_3$ existing in the electrolytic oxidation ceramic coating. Generally, hardness of $\gamma$-$Al_2O_3$ is lower than that of $\gamma$- $Al_2O_3$, and toughness of $\gamma$-$Al_2O_3$ is higher than that of $\alpha$- $Al_2O_3$. Therefore, hardness of the electrolytic oxidation ceramic coating according to the first embodiment is lower than an electrolytic oxidation ceramic coating formed in a known electrolytic oxidation method. The electrolytic oxidation ceramic coating may include a titanium component.

According to the first embodiment, even though silicon exits on the surface of the base material (aluminum alloy), the generation of a large projection on a surface of the zirconium oxide is restricted. In other words, the large surface projection does not exist on the electrolytic oxidation ceramic coating. The roughness of the surface of the electrolytic oxidation ceramic coating is about Ra=0.424 μm, Rzjis=2.64 μm, and the smoothness of the electrolytic oxidation ceramic coating is high. The hardness of the electrolytic oxidation ceramic coating is within a range from HV 500 to HV 550, more specifically, within a range from HV 515 to HV 535.

A first comparative example is carried on under the similar condition to the first embodiment, in which an electrolytic oxidation ceramic coating (target thickness: 5 micrometers as in the first embodiment) is formed on the test piece 1. According to the first comparative example, an electrolytic oxidation, more specifically, a plasma electrolytic oxidation is executed under the similar condition to the first embodiment. In the first comparative example, an alkali electrolyte is used, which includes a phosphor compound and a zirconium compound as in the first embodiment, but which does not include a titanium compound.

Figure 8:
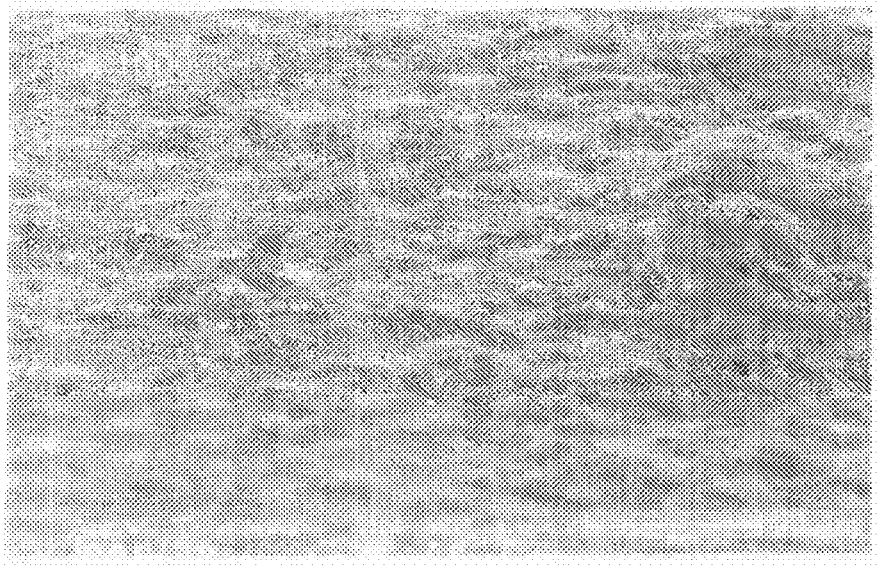
FIG. 8 is a diagram illustrating a surface of the electrolytic oxidation ceramic coating formed in the electrolytic oxidation according to a first comparative example.
Figure 9:
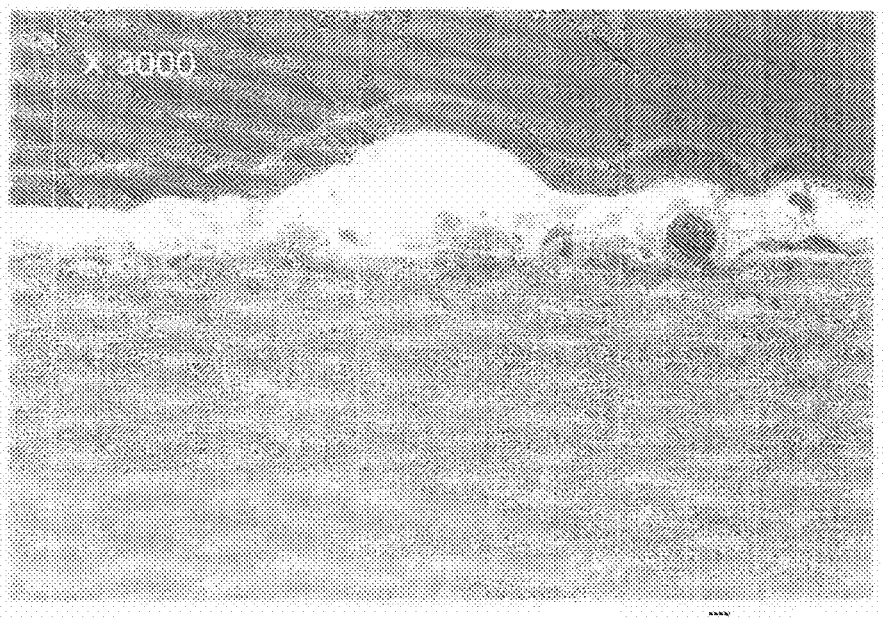
FIG. 9 is a diagram illustrating a cross-section of the electrolytic oxidation ceramic coating formed in the electrolytic oxidation according to the first comparative example.
Figure 11:
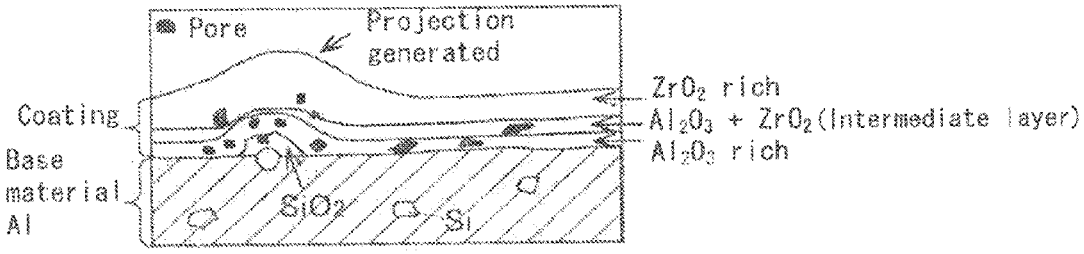
FIG. 11 is a schematic diagram illustrating the cross-section of the electrolytic oxidation ceramic coating formed in the electrolytic oxidation according to the first comparative example.

FIGS. 8 and 9 each illustrate a configuration of the electrolytic oxidation ceramic coating observed by the scanning electron microscope (SEM) according to the first comparative example. FIG. 8 illustrates a surface of the electrolytic oxidation ceramic coating (magnification ratio: 1000-fold). FIG. 9 illustrates a cross-section of the electrolytic oxidation ceramic coating (magnification ratio: 3000-fold). FIG. 11 schematically illustrates the cross-section of the electrolytic oxidation ceramic coating more clearly. Similarly to the first embodiment, the electrolytic oxidation ceramic coating according to the first comparative example includes an aluminum oxide layer, a zirconium oxide layer and an intermediate layer. The aluminum oxide layer is rich in aluminum oxide ($Al_2O_3$, shown in light gray in FIGS. 8 and 9), coated on the surface of the main body, having the aluminum alloy as the base material. The zirconium oxide layer, forming the most outer layer of the electrolytic oxidation ceramic coating, is rich in zirconium oxide ($ZrO_2$, shown in white in FIGS. 8 and 9). The intermediate layer, positioned between the aluminum oxide layer and the zirconium oxide layer, includes the aluminum oxide ($Al_2O_3$) and the zirconium oxide ($ZrO_2$). The surface of the test piece 1 is rich in aluminum oxide because aluminum is supplied from the surface of the test piece 1. The most outer layer of the electrolytic oxidation ceramic coating is rich in zirconium oxide because zirconium is included in the electrolyte 2 and is supplied therefrom.

As illustrated in FIGS. 7 and 9, in each of the first embodiment and the first comparative example, the aluminum oxide is rich in the vicinity of the surface of the test piece 1 (the main body), and the zirconium oxide is rich in the vicinity of the most outer surface of the electrolytic oxidation ceramic coating. In other words, the electrolytic oxidation ceramic coating according to each of the first embodiment and the first comparative example is configured so that the inner layer thereof close to the surface of the test piece 1 is richer in aluminum oxide than the most outer surface of the electrolytic oxidation ceramic coating and so that the outer layer thereof close to the most outer surface of the electrolytic oxidation ceramic coating is richer in zirconium oxide than the inner layer thereof close to the surface of the test piece 1 (the main body).

Because the aluminum alloy, serving as the base material of the test piece 1, includes silicon, a base of the main body that has the aluminum alloy as the base material includes silicon particles. According to the first comparative example, a large surface projection ($ZrO_2$, shown in white in FIG. 9) exists at a portion where the silicon protrudes from the surface of the aluminum base material. The surface roughness of the electrolytic oxidation ceramic coating according to the first comparative example, on which the surface projection is generated, is about Ra=0.85 μm. The smoothness of the electrolytic oxidation ceramic coating may not be satisfactory.

As illustrated in FIG. 6, a plurality of pinhole-shaped pores is formed dispersedly on the electrolytic oxidation ceramic coating according to the first embodiment. A microscope field shown in FIG. 6 is about 120 μm wide in a longitudinal direction thereof and about 84 μm long in a vertical direction thereof. Therefore, a dimension of the microscope field shown in FIG. 6 is about 10000 $\mu m^2$ (i.e. 120 μm×84 μm=10080 $\mu m^2 \approx 10000\ \mu m^2$). In the microscope field shown in FIG. 6 (about 10000 $\mu m^2$), the number of pores (i.e. openings on the surface of the electrolytic oxidation ceramic coating), whose diameter is 5 μm or less, is about 200 to 400. Such pores of appropriate size restrict the roughness of the surface of the electrolytic oxidation ceramic coating, and include a function of retaining a lubricant, such as lubricating oil, on the surface of the electrolytic oxidation ceramic coating. Further, although a mechanism of formation of pores is not necessarily clear, it is presumed that gas emission causes the generation of the pores on the surface of the electrolytic oxidation ceramic coating A sliding test (see FIG. 12) is executed on the above-described test piece 1. A mating member is formed into a substantially ring shape. The mating member is made of iron or alloy including iron (material equivalent to a piston ring, i.e., SWOSC-V). The mating member is hardened in high-frequency, and therefore the mating member includes a hardening structure. Roughness of the mating member is specified to be Rzjis 2.44 μm.

According to the above-described sliding test, the mating member is made of iron or alloy including iron (SWOSC-V), but the mating member may not be limited to be made of iron series (SWOSC-V), and may be made of SWO-A, SWO-B, SWO-V, SWOSC-B, SWOSM-A, SWOSM-B, SWOSM-C, SWOCV-V, SUP6, SUP7, SUP9, SUP10, SUP11A, SUP12, S55C, S45C and the like, depending on an actual usage condition.

Figure 12:
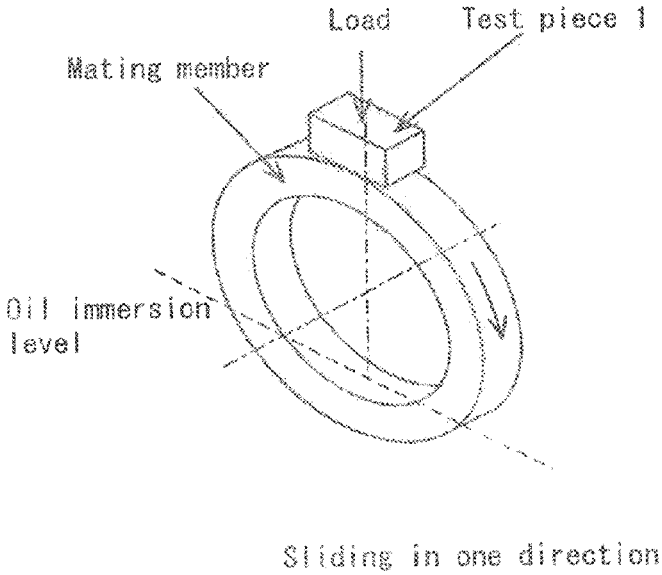
FIG. 12 is a perspective view illustrating a manner of a sliding test.

As illustrated in FIG. 12, conditions of the above-described sliding test are that a bottom portion of the ring-shaped mating member is immersed in the lubricating oil to an oil immersion level, the mating member is rotated around an axis thereof, the test piece 1 is thrust to an outer circumferential surface of the mating member by a predetermined level of load, and the mating member slides relative to the electrolytic oxidation ceramic coating of the test piece 1 in one direction. According to the first embodiment, the load is specified to be 588N, an average sliding speed is specified to be 0.3 m/second, a rotational speed is specified to be 50 rpm to 250 rpm, an engine oil (5w-30) is used as the lubricating oil, a temperature of the lubricating oil is left to nature, and a sliding time is specified to be 30 minutes. Then, an appearance of the surface of the electrolytic oxidation ceramic coating formed on the test piece 1 is observed before and after the sliding test with a naked eye as well as by the scanning electron microscope (SEM), and a comparative abrasion amount is calculated. The comparative abrasion amount is calculated by the following equation: Comparative abrasion amount={Abrasion amount ($mm^3$)/(Entire sliding distance (m)×Load (N)).

Figure 13:
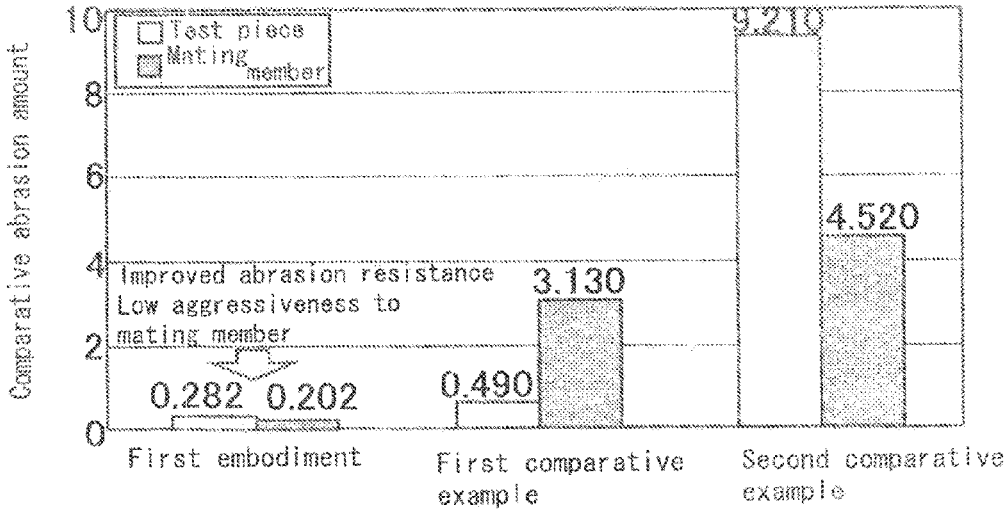
FIG. 13 is a diagram illustrating results of the sliding test.

According to a second comparative example, an anodic oxide coating (a hard anodic oxide coating) is formed in a known anodization. Conditions of the anodizaion is that a direct current is applied in a sulfuric acid aqueous solution, an electric voltage is specified to be 40 volt, a current density is specified to be 2 ampere/$dm^2$, a constant current is applied, and the speed of coating formation is specified to be 1 micrometer/minute. Further, the sliding test is also executed in the first and second comparative examples. FIG. 13 illustrates results of the sliding test. As illustrated in FIG. 13, both of the comparative abrasion amount of the test piece 1 (the electrolytic oxidation ceramic coating) and the comparative abrasion amount of the mating member are small in the first embodiment. The comparative abrasion amount of the test piece 1 and the comparative abrasion amount of the mating member are small because abrasion resistance of the test piece 1 is improved while aggressiveness of the test piece 1 to the mating member is relatively low in the first embodiment. On the other hand, according to the first comparative example, the hardness of the test piece 1 (the electrolytic oxidation ceramic coating) is relatively high (HV 800 or more) and the aggressiveness of the test piece 1 to the mating member is also relatively high. Although the hardness of the electrolytic oxidation ceramic coating is relatively high, a self-abrasion amount of the electrolytic oxidation ceramic coating is also relatively large because of the surface projection generated on the surface of the electrolytic oxidation ceramic coating. Further, according to the second comparative example, the hardness of the anodic oxide coating (hard anodic oxide coating) is about HV 400, and the comparative abrasion amount of the test piece 1 is relatively large. The comparative abrasion amount of the mating member is also large because of abrasion powder.

[Second, Third and Fourth Embodiments]

[Modification of Voltage Waveform]

Figure 4:
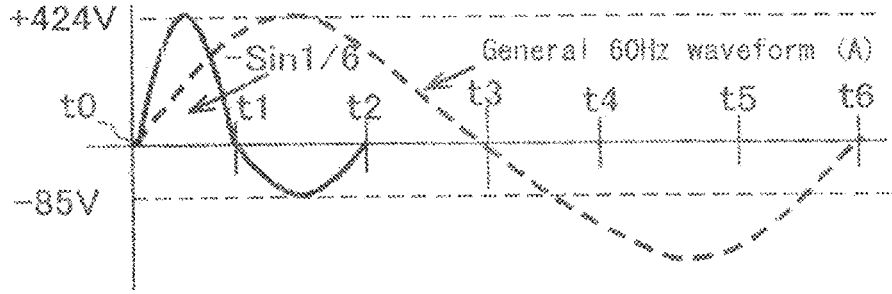
FIG. 4 is a waveform diagram illustrating the waveforms of the voltage applied between the test piece and the mating pole in the electrolytic oxidation according to a third embodiment.

Second to fourth embodiments are further executed. According to the second embodiment, the alternative current voltage is applied between the test piece 1 and the mating pole 5 so as to form an electrolytic oxidation ceramic coating under the similar conditions to the first embodiment. According to the third and forth embodiments, waveforms of the alternative current voltage, which is applied between the test piece 1 and the mating pole 5, are modified. More specifically, according to the third embodiment, as waveforms (duty ratio: 2/6≈0.33) are illustrated in FIG. 4, the pulse of the positive electric potential is applied from time t0 (energization starting time) to time t1 (2.78 milliseconds) so that the maximum voltage becomes +424 volt. Subsequently, the pulse of the negative electric potential is applied from time t1 (2.78 milliseconds) to time t2 (5.56 milliseconds) so that the maximum voltage becomes −85 volt. Subsequently, the voltage is not applied from time t2 (5.56 millisecond) to time t6 (16.67 milliseconds) (i.e., non-energization time). Thus the periodical alternative current voltage is repetitively applied.

Figure 5:
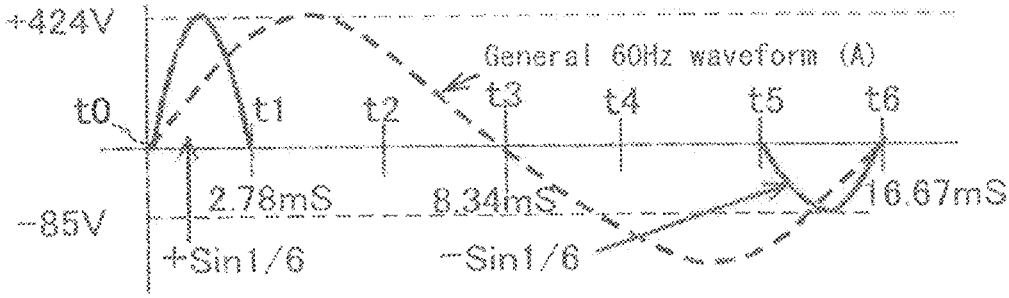
FIG. 5 is a waveform diagram illustrating the waveforms of the voltage applied between the test piece and the mating pole in the electrolytic oxidation according to a fourth embodiment.

According to the fourth embodiment, as waveforms (duty ratio: 2/6≈0.33) are illustrated in FIG. 5, the pulse of the positive electric potential is applied from time t0 (energization starting time) to time t1 (2.78 milliseconds) so that the maximum voltage becomes +424 volt. Subsequently, the voltage is not applied from time t1 (2.78 millisecond) to time t5 (13.90 milliseconds) (i.e., non-energization time). Subsequently, the pulse of the negative electric potential is applied from time t5 (13.90 milliseconds) to time t6 (16.67 milliseconds) so that the maximum voltage becomes −85 volt. Thus, the periodical alternative current voltage is repetitively applied.

The following table 1 illustrates results of the test according to the second to forth embodiments. According to the second to fourth embodiments, the roughness of the surface of the electrolytic oxidation ceramic coating, the thickness of the electrolytic oxidation ceramic coating, the speed of coating formation, the hardness of the electrolytic oxidation ceramic coating are suitable. According to each of the second to fourth embodiments, Vickers hardness is measured, using a load of 5 g. Accordingly, generation of the surface projections, which may cause abrasion, is restricted in each of the second to fourth embodiments. Further, because the smoothness of the electrolytic oxidation ceramic coating is improved, the self-abrasion amount of the electrolytic oxidation ceramic coating (the test piece 1) is reduced while the aggressiveness to the mating member is decreased. Furthermore, because the hardness of the electrolytic oxidation ceramic coating is HV 500 to HV 600, which is an appropriate level of the hardness, the aggressiveness to the mating member is further decreased.

TABLE 1

| | Surface roughness Ra | Surface roughness Rzjis | Coating thickness μm | Speed of coating formation μm/min. | Hardness HV |
|---|---|---|---|---|---|
| 2nd Embodiment | 0.522 | 3.32 | 5.16 | 3.44 | 583 |
| 3rd Embodiment | 0.612 | 3.80 | 5.34 | 3.56 | 578 |
| 4th Embodiment | 0.568 | 3.74 | 5.18 | 1.72 | 501 |

According to the fourth embodiment shown in FIG. 5, a time frame between the time point when the application of the pulse of the positive electric potential finishes (time t1) to the time point when the application of the pulse of the negative electric potential starts (time t5) is relatively long. In such a case, the roughness of the surface of the electrolytic oxidation ceramic coating is restricted, but the speed of coating formation (1.72 μm/minute) is relatively slow. On the other hand, according to the third embodiment, a time frame between the time point when the application of the pulse of the positive electric potential finishes (time t1) to the time point when the application of the pulse of the negative electric potential starts (time t2) is relatively short. In such a case, the speed of coating formation (3.56 μm/minute) is relatively quick, but the roughness of the surface of the electrolytic oxidation ceramic coating increases (0.612 μm).

Further, according to each of the first to fourth embodiments, the speed of coating formation of the electrolytic oxidation ceramic coating is relatively quick but the roughness of the electrolytic oxidation ceramic coating increases in a case where the distance between the test piece 1 and the mating pole 5 is relatively short, compared to a case where the distance between the test piece 1 and the mating pole 5 is relatively long.

[Fifth Embodiment]

Figure 14:
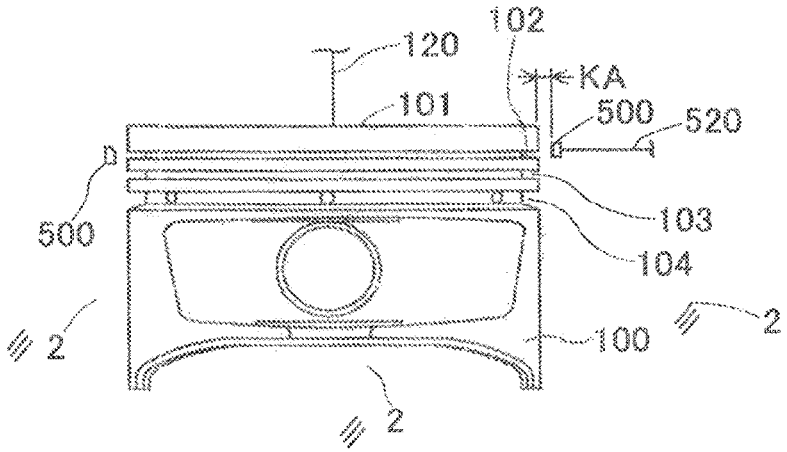
FIG. 14 is a side view schematically illustrating a state in which the electrolytic oxidation ceramic coating is formed on surfaces of a piston ring groove.
Figure 15:
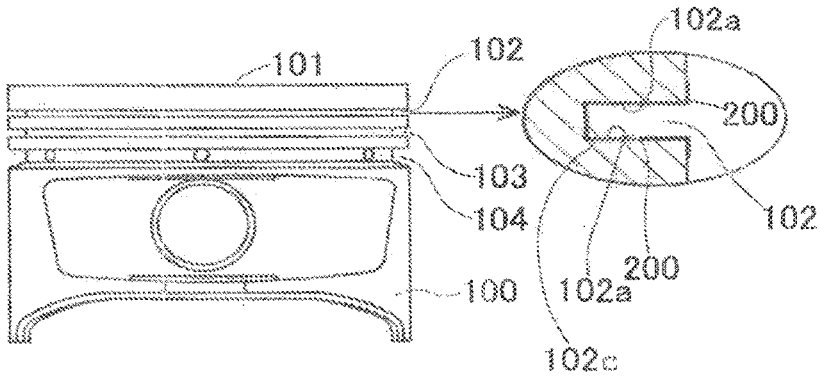
FIG. 15 is a side view illustrating the piston in which the electrolytic oxidation ceramic coating is formed on the surfaces of a piston ring groove.

FIGS. 14 and 15 correspond to the fifth embodiment. Configuration of the fifth embodiment is similar to the first embodiment. According to the fifth embodiment, a piston 100 (a member including a recessed portion and serving as a piston body and the main body) is applied. First, second and third piston ring grooves 102, 103 and 104 are formed at the piston 100. The first to third piston ring grooves 102, 103, and 104 serve as a plurality of ring grooves, which are applied to an internal combustion engine of a vehicle, such as an automobile, and the like. The piston 100 is made of the aluminum alloy. The aluminum alloy is made of a casted part (a die casted part, a sand casted part) or a sintered part, each of which includes 10% to 30% of silicon in mass ratio. The piston 100 is formed in a manner where a cutting process is executed on the casted part or the sintered part. Further, the piston 100 may be formed in a manner where the cutting process is executed on a forged part, or a compacted part, in which rapidly consolidated powder is solidified. At the time of coating formation, a covering layer of silicon rubber and the like is arranged at a portion of the piston 100 other than the first piston ring 102, which is closest to a head surface 101 among the first to third piston ring grooves 102, 103 and 104. Then, the piston 100 and a mating pole 500 are immersed into the alkali electrolyte 2 in a state where the first piston ring groove 102 faces the ring-shaped mating pole 500, which is made of stainless steel (SUS304). A distance KA between the mating pole 500 and an outer circumferential surface of the piston 100 in the vicinity of the first piston ring groove 102 is specified to be 0.5 to 50 millimeters, or more specifically, 10 to 20 millimeters. Then, the electrolytic oxidation is executed under the similar condition to the first embodiment, in which the alternative current voltage, showing the pulse of the positive electric potential and the pulse of the negative electric potential, is applied between the piston 100 and the mating pole 500 via a first power supplying portion 120 and a second power supplying portion 520 for 30 to 600 seconds. Consequently, an electrolytic oxidation ceramic coating 200, whose thickness is 2 to 20 μm, or more specifically, 3 to 10 μm, is formed. More specifically, as illustrated in FIG. 15, the electrolytic oxidation ceramic coating 200 is formed on groove side surfaces 102*a*, which face each other, and on a groove bottom surface 102*c*. Subsequently, the covering layer for masking is removed from the piston 100.

Figure 16:
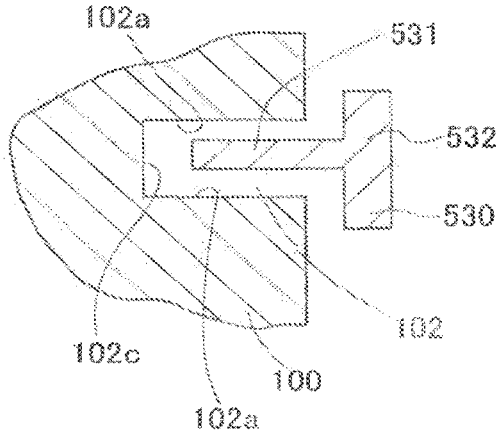
FIG. 16 is a side view illustrating schematically illustrating a state in which the electrolytic oxidation ceramic coating is formed on surfaces of a piston ring groove.

A piston ring, made of iron or alloy including iron, is attached to the first piston ring groove 102. Therefore, the electrolytic oxidation ceramic coating 200 slides relative to the piston ring (the mating member). The electrolytic oxidation ceramic coating 200 is not limited to be formed on the first piston ring groove 102, but may be formed on the second and third piston ring grooves 103 and 104. Further, a ring-shaped mating pole 530 shown in FIG. 16 may be applied. The mating pole 530 includes an insertion portion 531 and a facing portion 532. The insertion portion 531 may be inserted into a spaced portion of the first piston ring groove 102, the spaced portion being surrounded by the groove side surfaces 102*a* and the groove bottom surface 102*c*. The facing portion 532 faces the outer circumferential surface of the piston 100 so as to be distant therefrom. The electrolytic oxidation ceramic coating may be formed on wall surfaces of the first piston ring groove 102 in a manner where the insertion portion 531 of the mating pole 530 is inserted into the spaced portion of the first piston ring groove 102, and energization is executed between the mating pole 530 and the piston 100. Because the insertion portion 531 of the mating pole 530 is inserted into the first piston ring groove 102, the insertion portion 531 of the mating pole 530 is positioned close to the groove side surfaces 102*a* and the groove bottom surface 102*c* of the first piston ring groove 102.

[Other Embodiments]

According to the first to fifth embodiments, the electrolytic oxidation ceramic coating is formed on the piston 100, whose base material is the aluminum alloy and which is mounted on the internal combustion engine. Alternatively, the electrolytic oxidation ceramic coating may be formed on a piston, whose base material is aluminum alloy and which is mounted on an external combustion engine. Further, the electrolytic oxidation ceramic coating may be formed on an inner wall surface of a cylinder bore of a cylinder block, whose base material is the aluminum alloy and which is mounted on either the internal combustion engine or the external combustion engine. The electrolytic oxidation ceramic coating may be formed on an inner circumferential wall surface of a cylinder, whose base material is the aluminum alloy and which is mounted on a brake device. The electrolytic oxidation ceramic coating may be formed on an outer circumferential wall surface of a spool valve, whose base material is the aluminum alloy. The electrolytic oxidation ceramic coating may be formed on an inner circumferential wall surface of a spool hole for sliding the spool valve, whose base material is the aluminum alloy.

According to the first to fourth embodiments, one period of frequency of the alternative current voltage is divided into six parts, and the pulse of the positive electric potential is applied for 1/6 period while the pulse of the negative electric potential is applied for 1/6 period. However, not limited to the above-described embodiments, one period of the alternative current voltage may be divided into four parts, and the pulse of the positive electric potential may be applied for 1/4 period while the pulse of the negative electric potential is applied for 1/4 period. Further, one period of the alternative current voltage may be divided into eight parts, and the pulse of the positive electric potential may be applied for 1/8 period while the pulse of the negative electric potential is applied for 1/8 period. According to the first to fourth embodiments, time length for applying the pulse of the positive electric potential and time length for applying the pulse of the negative electric potential are substantially the same. However, the time length for applying the pulse of the negative electric potential may be shorter than the time length for applying the pulse of the positive electric potential.

The electrolytic oxidation ceramic coating is not limited to the configuration shown in FIG. 10, and may include an inner layer, which is rich in aluminum oxide ($Al_2O_3$) coated on the surface of the main body (test piece 1) having the aluminum alloy as the base material, an outer layer, which forms a most outer layer of the electrolytic oxidation ceramic coating and is rich in titanium oxide ($TiO_2$), and an intermediate layer, which is positioned between the inner and outer layers, and includes the aluminum oxide ($Al_2O_3$) and the titanium oxide ($TiO_2$).

According to the aforementioned description, the following technical idea is also obtainable.

An aluminum alloy member including a main body having an aluminum alloy serving as a base material and an electrolytic oxidation ceramic coating coated at a portion of a surface of the main body and including a most outer layer and an inner layer which is arranged close to the main body relative to the most outer layer, the inner layer in which an aluminum oxide is richer than the most outer layer, the most outer layer in which at least one of a zirconium oxide and a titanium oxide is richer than the inner surface, wherein a surface projection is prevented from generating on the electrolytic oxidation ceramic coating and a surface roughness Ra thereof is specified to be equal to or smaller than 0.7 μm An aluminum alloy member including a main body having an aluminum alloy serving as a base material and an electrolytic oxidation ceramic coating coated at a portion of a surface of the main body and including a most outer layer and an inner layer which is arranged close to the main body relative to the most outer layer, the inner layer in which an aluminum oxide is richer than the most outer layer, the most outer layer in which at least one of a zirconium oxide and a titanium oxide is richer than the inner surface.

The present embodiment is applicable to an aluminum alloy member used for a component for a vehicle, an industrial instrument, and the like and a method for manufacturing the same.

According to the aforementioned embodiments, the meaning of "the aluminum oxide is rich" is that a dimensional ratio of the aluminum oxide is greater than a dimensional ratio of a volume of the titanium oxide or a total volume of the titanium oxide and the zirconium oxide. The meaning of "the volume of the titanium oxide or the total volume of the titanium oxide and the zirconium oxide is rich" is that a dimensional ratio of the titanium oxide or a dimensional ratio of the total of the titanium oxide and the zirconium oxide is greater than a dimensional ratio of the aluminum oxide. That is, the dimensional ratio is greater when a component in a thickness direction of a cross section of the electrolytic oxidation ceramic coating is analyzed by an electron probe micro-analyzer (EPMA), an energy dispersive X-ray fluorescence (EDX), an X-ray fluorescence, and the like. Accordingly, in a case where the electrolytic oxidation ceramic coating is analyzed by the aforementioned method, the dimensional ratio of the aluminum oxide in the electrolytic oxidation ceramic coating is larger at an inner surface (i.e., an inner layer) close to the main body than that at a most outer surface (i.e., a most outer layer) of the electrolytic oxidation ceramic coating. In addition, the dimensional ratio of the volume of the titanium oxide or the total volume of the titanium oxide and the zirconium oxide is greater at the most outer layer than that at the inner layer. The dimensional ratio of the aluminum oxide and the dimensional ratio of the total of the zirconium oxide and the titanium oxide may continuously vary in the thickness direction of the electrolytic oxidation ceramic coating or may discontinuously vary in the thickness direction of the electrolytic oxidation ceramic coating.

In a case where the electrolytic oxidation ceramic coating is formed only by the aluminum oxide, the hardness thereof is excessive for the mating member. According to the aforementioned embodiments, the zirconium oxide enhances toughness of the entire electrolytic oxidation ceramic coating, prevents an excessive increase of the hardness of the electrolytic oxidation ceramic coating, and improves a corrosion resistance. The titanium oxide functions in the same way as the zirconium oxide.

According to the aforementioned embodiments, a surface roughness Ra of the electrolytic oxidation ceramic coating is specified to be equal to or smaller than 0.7 μm.

In addition, the surface projection is prevented from generating on the electrolytic oxidation ceramic coating and the surface roughness Ra thereof is specified to be equal to or smaller than 0.7 μm.

According to the electrolytic oxidation ceramic coating of the aforementioned embodiments, because a generation of the surface projection from which the abrasion tends to originate is restrained, the surface roughness Ra of the electrolytic oxidation ceramic coating is specified to be equal to or smaller than 0.7 μm. Thus, the self-abrasion amount of the electrolytic oxidation ceramic coating is small and the hardness of the electrolytic oxidation ceramic coating is appropriate, which leads to the small aggressiveness to the mating member.

Considering that the abrasion tends to originate from the surface projection, it is desirable that no surface projections exist at the electrolytic oxidation ceramic coating and the surface roughness of the electrolytic oxidation ceramic coating is small when the electrolytic oxidation ceramic coating slides with the mating member. Accordingly, the lower limit of the surface roughness Ra of the electrolytic oxidation ceramic coating is 0.1 μm, 0.2 μm, or 0.3 μm, for example.

According to the aforementioned embodiments, the average hardness of the electrolytic oxidation ceramic is equal to or smaller than HV 600 and is greater than the average hardness of the main body (test piece 1).

In addition, according to the aforementioned embodiments, the average thickness of the electrolytic oxidation ceramic coating is specified in a range from 1 to 50 micrometers.

Further, according to the aforementioned embodiments, the aluminum alloy includes silicon equal to or smaller than 30% in mass ratio.

Furthermore, a sliding apparatus including the aluminum alloy member according to the aforementioned embodiments and a mating member slidable with the aluminum alloy member, wherein the electrolytic oxidation ceramic coating is slidable with the mating member.

According to the electrolytic oxidation ceramic coating of the aforementioned embodiments, the generation of the surface projection is restrained, which leads to an enhancement of flatness of the electrolytic oxidation ceramic coating. This is because the titanium compound or titanium included in the electrolyte functions as a catalyst upon electrolytic oxidation to thereby accelerate a generation of the aluminum oxide, the zirconium oxide, and the titanium oxide included in the electrolytic oxidation ceramic coating. The generation of the surface projection is prevented accordingly. The surface roughness of the electrolytic oxidation ceramic coating is reduced. The aluminum oxide and the zirconium oxide may be either crystalline or amorphous and may include a titanium compound (oxide).

The average hardness of the electrolytic oxidation ceramic coating is equal to or smaller than HV 600. The electrolytic oxidation ceramic coating is desirably harder than the base material constituting the main body. Thus, the average hardness of the electrolytic oxidation ceramic coating is in a range from HV 400 to HV 600. Then, toughness of the electrolytic oxidation ceramic coating is ensured and the aggressiveness to the mating member decreases. The lower limit of the average hardness of the electrolytic oxidation ceramic coating is HV 400, HV 425, or HV 450, for example. The upper limit of the average hardness of the electrolytic oxidation ceramic coating is HV 600, HV 575, or HV 550, for example.

A sliding member serves as the main body, for example. The aluminum alloy constituting the base material of the main body may be a casted part, a forged part, or a sintered part. The sintered part is obtained by a sinter of a consolidation compact achieved by a consolidation of alloy powder such as rapidly solidified powder. An alloy of aluminum and silicon, an alloy of aluminum, silicon, and magnesium, an alloy of aluminum, silicon, and copper, and an alloy of aluminum, silicon, copper, and magnesium, all of which include silicon, are applicable to the aluminum alloy, for example. In this case, unavoidable impurities may be included. In addition, in this case, 10% or less, 15% or less, 20% or less, or 30% or less silicon by weight may be included. The greater the silicon content is, the lower the uniformity of the electrolytic oxidation ceramic coating is. This is due to a difference in an electric resistance between the silicon and aluminum base material. The aforementioned aluminum alloy may include 10% or less or 15% or less copper. In addition, the aforementioned aluminum alloy may include 5% or less or 10% or less magnesium. According to the aforementioned embodiments, even when the silicon is included in the base material, the generation of the surface projection is restrained during a forming of the coating and the surface roughness of the electrolytic oxidation ceramic coating is reduced, which is an advantage for forming the electrolytic oxidation ceramic coating at the aluminum alloy that includes the silicon.

In the electrolytic oxidation ceramic coating, the generation of the surface projection from which the abrasion tends to originate is desirably restrained and the surface roughness Ra is desirably specified to be equal to or smaller than 0.7 μm. Because the generation of the surface projection from which the abrasion tends to originate is restrained, the self-abrasion amount of the electrolytic oxidation ceramic coating is reduced and the aggressiveness to the mating member is restrained. Further, because the hardness of the electrolytic oxidation ceramic coating is not excessive and is appropriate, the aggressiveness to the mating member is further reduced. In order to maintain the aforementioned effects, the surface roughness Ra of the electrolytic oxidation ceramic coating is specified to be 0.6 μm or less, 0.5 μm or less, 0.4 μm or less, or 0.3 μm or less, for example.

In a case where the zirconium oxide is rich in the electrolytic oxidation ceramic coating, the aforementioned electrolyte desirably includes the zirconium compound and the titanium compound. In a case where the titanium oxide is rich in the electrolytic oxidation ceramic coating, the aforementioned electrolyte desirably includes the titanium compound.

The zirconium compound may desirably be soluble. The soluble zirconium compound is advantageous for densification of the electrolytic oxidation ceramic coating. Organic acid zirconium salt such as zirconium acetate, zirconium formate, and zirconium lactate is applicable to the zirconium compound. In addition, zirconium complex salt such as potassium zirconium carbonate, ammonium zirconium carbonate, ammonium zirconium acetate, and sodium zirconium oxalate is applicable to the zirconium compound. More specifically, potassium zirconium carbonate ($K_2[Zr(OH)_2(CO_3)_2]$) is used as the zirconium compound. A density of the zirconium compound in the electrolyte is 2 g to 35 g or 6 g to 10 g per litter, for example. At least one of oxalate, carbonate, and silicate is applicable to the titanium compound. More specifically, potassium titanium oxalate ($K_2[TiO(C_2O_4)_2]$) is used as the titanium compound. The titanium compound or the titanium functions as a catalyst upon forming of the coating and is effective for enhancement of an oxide generation. Thus, the further densification of the electrolytic oxidation ceramic coating is achieved, thereby improving the surface roughness of the electrolytic oxidation ceramic coating and accelerating the formation speed of the coating.

A phosphorous compound is desirably included in the electrolyte. The soluble phosphorous compound is desirable. The phosphorous compound accelerates a generation of the aluminum oxide and contributes to a flatness of the surface of the electrolytic oxidation ceramic coating and stabilization of the electrolyte. Phosphate, polyphosphate, organic phosphonate, tartrate, citrate, and aminocarboxylate are applicable to the phosphorous compound. More specifically, at least one of sodium pyrophosphate ($Na_4$ $P_2O_7.10H_2O$) and the like is used as the phosphorous compound, for example. A density of the soluble phosphorous compound in the electrolyte is 10 g to 100 g or 20 g to 30 g per litter, for example.

According to the aforementioned embodiments, an atomic number ratio of zirconium to titanium is 1 to a range of 0.5 to 1.5.

In addition, according to the aforementioned embodiments, the voltage is the alternating current voltage.

Further, according to the aforementioned embodiments, the alternating current voltage includes the positive electric potential and the negative electric potential between which a non-energization time is provided.

Furthermore, according to the aforementioned embodiments, a duty ratio is in a range of 0.1 to 0.8.

Furthermore, according to the aforementioned embodiments, the main body is the piston body 100.

When an amount of titanium included in the electrolyte is excessively small, the smoothness of the surface of the electrolytic oxidation ceramic coating is improved while the formation speed of the electrolytic oxidation ceramic coating decreases. When an amount of titanium included in the electrolyte is excessively large, the formation speed of the electrolytic oxidation ceramic coating increases while the smoothness of the surface of the electrolytic oxidation ceramic coating is reduced. For example, the phosphor compound, zirconium compound and the titanium compound, included in the electrolyte, are described in the atomic number ratio as follows. Zirconium (Zr):Titanium (Ti)=(0.8 to 1.2):(0.8 to 1.2). Phosphor (P):Zirconium (Zr):Titanium (Ti) =(2.5 to 6):(0.8 to 1.2):(0.8 to 1.2).

When the temperature of the electrolyte is excessively high, the formation speed of the electrolytic oxidation ceramic coating increases while the smoothness of the surface of the electrolytic oxidation ceramic coating is reduced. The temperature of the electrolyte is not limited. However, the temperature of the electrolyte is generally specified to be 60° C. or less, 40° C. or less, or more specifically, 10° C. or less. The electrolyte may be cooled if necessary.

When the voltage is applied between the main body and the mating pole, the electricity may be discharged (glow discharge or arc discharge). While the electricity is being discharged, a portion of the surface layer of the main body is melted and coagulated. The electrolytic oxidation ceramic coating, whose main components are the aluminum oxide, the zirconium oxide and the titanium oxide, is formed while obtaining oxygen generated at a positive pole.

Either the alternative current voltage or the direct current voltage may be applied between the main body and the mating pole. However, when only the positive electric potential of the direct current voltage is applied, the roughness of the electrolytic oxidation ceramic coating may increase.

When the positive electric potential and the negative electric potential are both applied as in the application of the alternative current voltage, the formation speed of the electrolytic oxidation ceramic coating increases and the surface thereof is suitably formed. Therefore, the alternative current voltage may be applied so as to improve the smoothness of the electrolytic oxidation ceramic coating. When the alternative current voltage is applied, the non-energization time may be provided between the pulse of the positive electric potential and the pulse of the negative electric potential, so that the generation of the electrolytic oxidation ceramic coating is temporality stopped and the electrolytic oxidation ceramic coating is cooled. Further, when the positive electric potential and the negative electric potential are applied, heat is developed at the coating formed portion of the main body. For the pulse of the positive or negative electric potential, a sine wave, a square wave or a triangle wave is applied, for example.

The frequency of the alternative current voltage may be appropriately specified as long as the alternative current voltage includes the pulse of the positive and negative electric potential. For example, the frequency of the alternative current voltage includes 5 to 1500 Hz, 10 to 1000 Hz, 20 to 100 Hz, or 45 to 65 Hz. The non-energization time may be provided between the pulse of the positive electric potential and the pulse of the negative electric potential, which configure the alternative current voltage. The positive electric potential may be specified within a range of 50 to 600 volts or 80 to 500 volts, for example. The negative electric potential may be specified within a range of −10 to −400 volts or −20 to −300 volts, for example.

The duty ratio of the applying voltage may be within a range of 0.1 to 0.8, 0.2 to 0.7 or 0.2 to 0.5. According to such duty ratio, the appropriate voltage application time and the appropriate non-energization time may be obtained. Therefore, the electrolytic oxidation ceramic coating is suitably formed. The "duty ratio" mentioned herein is calculated in the following equation: Duty ratio=Voltage application time between main body and mating pole/Energization time. The "voltage application time" mentioned herein includes the time when the pulse of the positive and negative electric potential is applied.

An example may be provided hereinafter. A maximum level of applying voltage is specified to be 430 volts or less. The voltage is raised to the maximum voltage level within 1 to 10 milliseconds (more specifically, 1 to 3 milliseconds). An energization interval (non-energization time) between the pulse of the positive electric potential and the pulse of the negative electric potential is specified to be 1 to 15 milliseconds (more specifically, 5 to 8 milliseconds). The absolute value of the negative electric potential may be specified to be 2/3 to 1/10 (more specifically, 1/6 to 1/4) of the absolute value of the positive electric potential. Continuous frequency may be specified to be 10 to 200 Hz (more specifically, 50 to 60 Hz). Accordingly, power of the pulse of the positive electric potential may not become too high. Therefore, the smoothness of the electrolytic oxidation ceramic coating (zirconium oxide) is improved. When the power of the pulse of the positive electric potential decreases, the non-energization time between the pulse of the positive electric potential and the negative electric potential is shortened so as to maintain activeness of the surface of the electrolytic oxidation ceramic coating and restrict decrease in formation speed of coating.

Pulse-type direct voltage may be applied between the main body and the mating member 5. The "pulse-type direct voltage" mentioned herein refers to the fact that the energization time (ON time), in which the positive voltage is applied between the main body and the mating member, and the non-energization time (OFF time), in which the positive voltage is not applied between the main body and the mating member, are alternately specified.

The distance between the coating formed portion of the main body and the mating member at the time of coating formation may be appropriately specified on the basis of the voltage applied between the main body and the mating member, a discharge performance between the main body and the mating member, a composition of the electrolyte, and a concentration of the electrolyte. Generally, when the average distance between the main body and the mating member is relatively short, the electric current may easily flow between the main body and the mating member, a large amount of discharge may easily occur, and accordingly the roughness of the surface of the electrolytic oxidation ceramic coating may easily increase. On the other hand, when the average distance between the main body and the mating member 5 is relatively long, a small amount of discharge may occur between the main body and the mating member 5, discharge may weaken on a surface of a recessed portion and the like, and accordingly, the coating formation performance may be deteriorated. Further, the formation speed of the electrolytic oxidation ceramic coating may decrease and productivity may be reduced. Accordingly, the average distance between the coating formed portion of the main body and the mating member may suitably be specified to be 0.05 to 10 centimeters, or more specifically, 1 to 10 centimeters. However, not limited to the above-described distance, the average distance between the coating formed portion of the main body and the mating member may be specified to be 1.3 to 6 centimeters in a case where the applying positive electric potential is specified to be 350 to 430 volts.

The coating formation time is appropriately specified on the basis of the distance between the coating formed portion of the main body and the mating member, the level of the voltage applied between the main body and the mating member, the concentration of the electrolyte, the composition of the electrolyte, the target thickness of the electrolytic oxidation ceramic coating and the size of the main body. For example, the coating formation time may be specified to be about 10 seconds to 30 minutes, 20 seconds to 10 minutes, 30 seconds to 3 minutes, though not limited to the examples mentioned herein.

The coating formation speed is specified on the basis of the distance between the coating formed portion of the main body and the mating member, the level of the voltage applied between the main body and the mating member, the concentration of the electrolyte, the composition of the electrolyte, the target thickness of the electrolytic oxidation ceramic coating and the size of the main body. For example, the coating formation speed may be specified to be about 0.2 to 100 μm/min, 1 to 50 μm/min, or more specifically, 1 to 20 μm/min and 2 to 10 μm/min, though not limited to the examples mentioned herein.

The pin-hole shaped pores may be formed on the electrolytic oxidation ceramic coating. The number of pores seen in the microscope filed of 10000 $\mu m^2$ may be 30 to 2000, 100 to 1000, and 150 to 500.

According to the embodiments, the generation of the surface projection is restricted. Accordingly, the self-abrasion amount of the electrolytic oxidation ceramic coating is decreased and the aggressiveness to the mating member is reduced. Further, the hardness of the electrolytic oxidation ceramic coating is restricted and therefore the aggressiveness to the mating member is further reduced.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

The invention claimed is:

1. A method for manufacturing an aluminum alloy member, comprising steps of:

preparing a main body including an aluminum alloy serving as a base material and an electrolyte including a zirconium compound and a titanium compound or an electrolyte including the titanium compound; and forming an electrolytic oxidation ceramic coating at a portion of a surface of the main body by applying a voltage between the main body and a mating pole in a state where the main body and the mating pole are immersed in the electrolyte, wherein the titanium compound is an oxalate, and wherein the electrolytic oxidation ceramic coating has from 200 to 400 pores having a diameter of 5 μm or less per 10,000 $\mu m^2$.

2. The method for manufacturing the aluminum alloy member according to claim 1, wherein a surface roughness Ra of the electrolytic oxidation ceramic coating is specified to be equal to or smaller than 0.7 μm.

3. The method for manufacturing the aluminum alloy member according to claim 1, wherein a surface projection is prevented from generating on the electrolytic oxidation ceramic coating and a surface roughness Ra thereof is specified to be equal to or smaller than 0.7 μm.

4. The method for manufacturing the aluminum alloy member according to claim 1, wherein an atomic number ratio of zirconium to titanium is 1 to a range of 0.5 to 1.5.

5. The method for manufacturing the aluminum alloy member according to claim 1, wherein the voltage is an alternating current voltage.

6. The method for manufacturing the aluminum alloy member according to claim 5, wherein the alternating current voltage includes a positive electric potential and a negative electric potential between which a non-energization time is provided.

7. The method for manufacturing the aluminum alloy member according to claim 1, wherein a duty ratio is in a range of 0.1 to 0.8.

8. The method for manufacturing the aluminum alloy member according to claim 1, wherein the main body is a piston body.

* * * * *